United States Patent [19]

Meyn

[11] Patent Number: 4,575,993

[45] Date of Patent: Mar. 18, 1986

[54] MACHINE FOR PACKAGING EGGS

[76] Inventor: Pieter Meyn, Noordeinde 68C, 1511 AE Oostzaan, Netherlands

[21] Appl. No.: 504,526

[22] Filed: Jun. 15, 1983

[30] Foreign Application Priority Data

Jun. 16, 1982 [NL] Netherlands ..... 8202431

[51] Int. Cl.[4] ..... B65B 23/06

[52] U.S. Cl. ..... 53/534; 53/246; 53/248; 53/544

[58] Field of Search ..... 53/246, 247, 248, 251, 53/261, 537, 539, 534, 544; 198/408, 424, 458; 414/736

[56] References Cited

U.S. PATENT DOCUMENTS

| | | | |
|---|---|---|---|
| 3,633,739 | 1/1972 | Renner | 53/534 |
| 3,820,301 | 6/1974 | Willsey | 53/544 |
| 4,189,898 | 2/1980 | Moulds et al. | 53/544 |

*Primary Examiner*—James F. Coan
*Attorney, Agent, or Firm*—Dority & Manning

[57] ABSTRACT

A machine for packaging eggs of the type having an egg orienting and aligning device for arranging the eggs, supplied at random by a conveyor, in successive cross rows of a predetermined number, an orienting device for orienting the eggs in each cross row with their blunt ends directed in the direction of forward movement with the longitudinal axes of the eggs equally spaced in each row at a first distance, and a transfer device for transferring the successive cross rows of the eggs so oriented to successive corresponding cross rows of the egg holding recesses of egg trays or the like, the centers of these recesses being spaced at a second smaller lateral distance. The invention provides such a transfer device having a horizontally extending cross row of cup-shaped egg holders slidably supported on a common shaft which is reciprocatingly rotated between an egg receiving position to receive a row of eggs from the transfer device and an egg discharging position to drop the eggs so received into a row of recesses of an egg tray during which rotation the egg holders are laterally moved on the shaft from the receiving position spaced at said first distance to a discharging position spaced at said smaller second distance.

9 Claims, 5 Drawing Figures

MACHINE FOR PACKAGING EGGS

BACKGROUND OF THE INVENTION

The invention relates to a machine for packaging eggs and more particularly to such a machine in which the eggs supplied thereto in random positions are first arranged and advanced in successive cross rows of a predetermined number of, for instance six eggs each, next the eggs are uniformly oriented so that their blunt ends all face in the same direction whereupon the successive cross rows of oriented eggs are transferred to successive corresponding cross rows of egg holding recesses of egg container means, such as egg trays.

Egg packaging machines of this type are well-known and may comprise orienting means which position the eggs, supplied at random, with their longitudinal axes extending in the direction of movement of the eggs through the machine and with their blunt ends facing forwardly. The mean distance between the axes of the oriented eggs of a cross row depends on the structure of the orienting means but this distance is generally greater than the length of the eggs of largest size to be processed. On the other hand, the eggs must be placed with their acute ends directed downwards into the recesses of the egg trays or the like and the distance between the centres of adjacent egg holding recesses of the tray is substantially smaller than the above-mentioned transverse distance of the eggs leaving the orienting means. It follows that the transfer means receiving the eggs from the orienting means not only should turn these eggs to direct their acute ends downward but should also move the eggs toward each other crosswise to a mutual distance corresponding to the transverse distance of the recesses of the egg tray.

SUMMARY OF THE INVENTION

It is an object of the present invention to provide a machine of the type described having transfer means which effectively perform the above-mentioned function of receiving the eggs from the orienting means spaced at a relatively large distance from each other, turning the eggs and bringing them closer together and then placing the eggs in the recesses of an egg tray or the like.

Another object of the invention is to provide such a transfer means which can perform this function with great speed and which discharges the eggs in the egg tray with a minimum risk of breakage.

According to the invention, the transfer means comprises a horizontally extending cross row of substantially cup-shaped egg holders mounted for common rotation and supported for relative transverse sliding movement which egg holders are periodically rotated between an egg receiving position adjacent said orienting means and an egg discharging position above the egg tray. The egg holders cooperate with egg holder control means which shift the egg holder laterally with respect to each other during this rotation, the egg holders in the receiving position being relatively spaced by the control means at a larger distance in alignment with the eggs in the cross rows as supplied by the orienting means, and the egg holders in the discharging position being relatively spaced by the control means at a smaller distance in alignment with the egg holding recesses of the egg trays, the holders facing downwards for dropping the eggs in these recesses. It is thus obtained that the eggs of a cross row supplied by the orienting means are each received in a separate egg holder in the spread position of the holders which eggs by the rotation of the row of holders are simultaneously turned to a position with their acute ends facing downward and are moved towards each other to the required smaller distance where upon the eggs are simultaneously dropped with their acute ends in a cross row of egg holding recesses of the egg tray. There is thus no possibility that the eggs touch each other and could break. On each back and forward rotation of the egg holders a row of for instance six eggs are simultaneously placed in the egg tray which allows for a high production rate.

BRIEF DESCRIPTION OF THE DRAWINGS

The present invention will be more readily understood and the further objects and advantages thereof will be more apparent when read in conjuction with the accompanying drawings in which.

DESCRIPTION OF A PREFERRED EMBODIMENT

Figure 1:
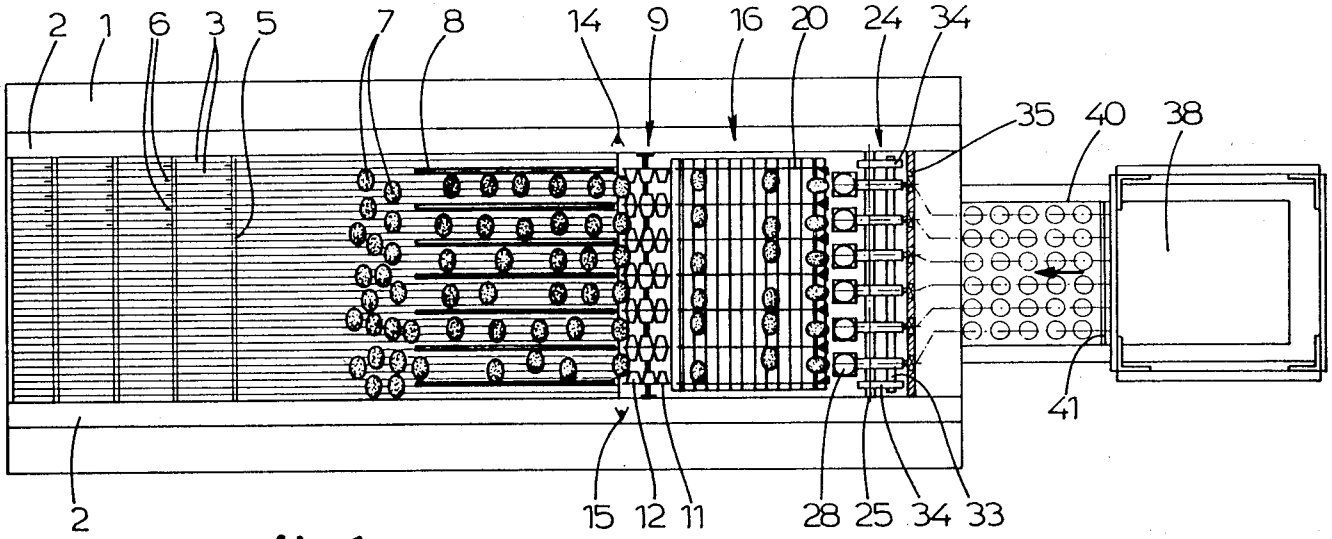
FIG. 1 is a plan view and partly a horizontal cross-section of a preferred embodiment of the machine according to the invention.
Figure 2:
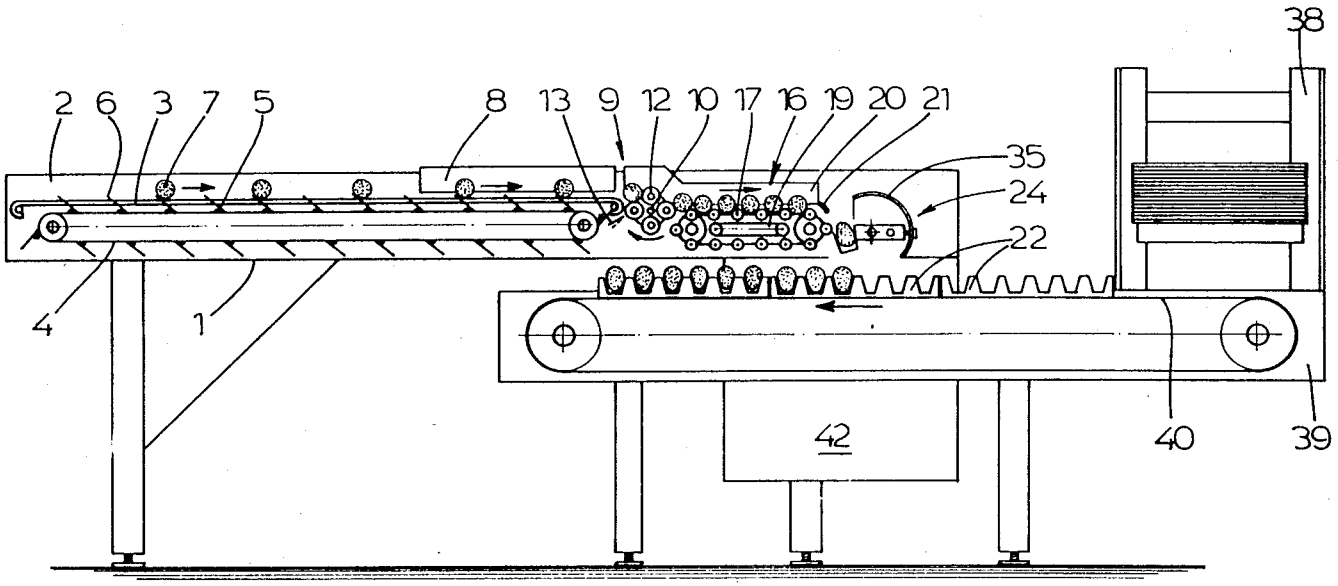
FIG. 2 is a side elevation of the machine of FIG. 1.

Referring to FIGS. 1 and 2 of the drawings, the machine for packaging eggs there shown comprises a table-like frame 1 supported on legs and having elongate horizontally extending side walls 2. A number of parallel longitudinally extending thin rods 3 are provided between these side walls 2. A conveyor 4 is arranged closely below the rods 3 which conveyor is driven in the direction of the arrow shown in FIG. 2. The conveyor 4 carries a plurality of uniformly spaced cross rods 5 with rearwardly inclined carrier fingers 6 secured thereto which project upwardly between the longitudinal rods 3. The eggs 7 to be packaged which may or may not be sorted to size are placed by hand or by automatic means not shown on the rods 3 of the table in random positions and these eggs are carried along by the fingers 6 in the direction of the arrows of FIG. 2. The eggs roll over the rods 3 and their longitudinal axes are thus perpendicular to the rods 3 in which, however, their acute ends may be facing one way or the other. Seven longitudinally extending vertical partitions 8 are arranged above the rear part of the row of rods 3 which partitions are together moved by drive means (not shown) with a transverse reciprocating movement in a manner well-known in the art in order to cause the eggs to enter the six tracks enclosed between the seven partitions.

A multiple star wheel 9 is rotatably mounted between the side walls 2 closely adjacent the downwardly bent rear ends of the rods 3. This star wheel comprises a shaft 10 carrying a number of supporting discs secured thereto and located in the vertical planes of the partitions 8. Each of the supporting discs 11 carries four circularly arranged conical projections 12 on one side or on both sides as shown in FIG. 1 in such a manner that in the space between two adjacent discs 11 the projections thereon are aligned leaving some clearance between their opposed truncated ends. The projections 12 on the several discs 11 have the same angular positions whereby a cross row of six eggs supplied by the conveyor 4 is received by the star wheel 9, each egg being supported on four projections 12. The star wheel 9 is rotated in steps of a quarter-turn by means not shown in which each following turning step occurs only after the star wheel device 9 has been filled and thus has received the next cross row of six eggs supplied by the conveyor 4. For that purpose a number of swivelling arms 13 may be arranged to the rear of the ends of the rods 3, each arm projecting into the space between two opposed projections 12 so as to be rotated by an arriving egg from the position shown with dotted lines in FIG. 2 to the position shown with full lines. A light source 14 arranged at one side of the star wheel 9 directs a light beam to a photocel 15 arranged on the opposite side which light beam is interrupted as long as still one of the arms 13 occupies the rest position shown in dotted lines. Only if all the arms 13 have been moved and therefore the star wheel has received the following six eggs, the photocel emits a signal causing the star wheel to be rotated through a quarter-turn for transferring the row of eggs to a orienting device 16 for the eggs arranged to the rear of the star wheel 9.

Figure 5:
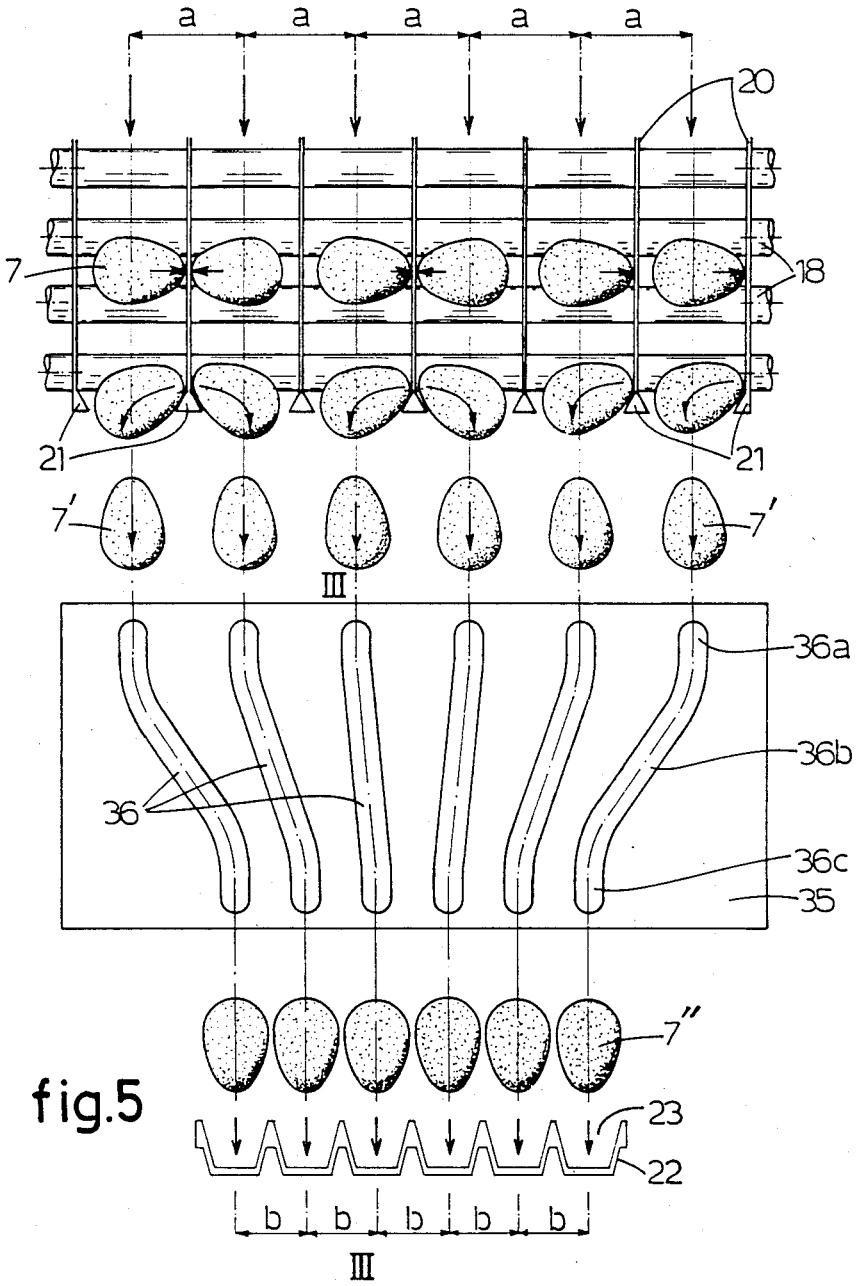
FIG. 5 is a schematical showing of the paths of movement of the eggs from the orienting device to the egg tray in which the curved guide plate with the guide slots formed therein is shown developed in the plane of the drawing.

The above described means for supplying and arranging the randomly supplied eggs in successive cross rows of a predetermined number, generally six, are known as such from the prior art. The same is true for the egg orienting device 16. This device comprises a roller chain 17 with supporting rolls 18 which receive and support the eggs in the spaces between successive rolls as shown to advance the eggs in the direction indicated by the arrow in FIG. 2. A moving belt 19 is arranged below the upper part of the roller chain 17 and engages the rolls of this upper chain part which belt is driven against the direction of movement of the roller chain whereby the rolls 18 in their advancing movement are also rotated about their axes. This causes the eggs each supported on two rolls 18 to be rotated about their longitudinal axes extending perpendicularly to their direction of forward movement and as a consequence of this rotation the eggs will also be shifted laterally in the direction of their acute ends in a manner well-known in the art. Longitudinally extending partition plates 20 are arranged above the roller chain 17 and again extend in the vertical planes of the partitions 8 and the supporting discs 11. These partition plates 20 have at their downstream ends a forwardly and downwardly extending projection 21 of triangular profile so as to form an inwardly projecting stop with an inclined stop surface as shown. These projections 21 or stops thus project laterally into the six tracks of movement of the eggs formed between the partition plates 20. On account of the above-discussed lateral displacement of the eggs rotating on the roller chain 17 each egg before reaching the end of the roller chain 17, will have moved to a transverse position with its acute end contacting the one or the other of the two partition plates 20 defining its track of movement and consequently the acute end of the egg will abut the projection 21 concerned at the end of the track. Thereby the eggs will be swung through an angle of approximately 90°, as shown in FIG. 5, thus leaving the roller chain 17 in a position in which their longitudinal axes are directed perpendicularly to the rolls 18 of the chain 17 and in which their acute ends are facing generally upwards vertically or at least at a small inclination. The mean distance a between the longitudinal axes of the eggs 7' when leaving the roller chain 17 (FIG. 5) is substantially equal to the spacing of the partition plates 20 which should of course be greater than the maximum possible length of the eggs to be processed. As mentioned above, the structure and functioning of the described orienting device 16 are as such well-known in the art.

The eggs 7' delivered by the orienting device 16 should, in the embodiment shown, be transferred to an egg tray 22 of conventional design and provided with for instance six cross rows each comprising six egg holding recesses 23 for receiving the cross rows of six eggs 7' each successively delivered by the orienting device 16. The transverse distance b between the centres of these egg holding recesses 23 is generally in the order of 48 mm and thus is substantially smaller than the above-mentioned distance a which is for instance 76 mm. It follows that the eggs 7' of each delivered cross row of eggs must be moved towards each other from said distance a to this mutual distance b as indicated for the eggs 7'' in FIG. 5. Furthermore, the eggs should be placed in the egg tray 22 with their acute ends facing downwards because the air bubble located inside the egg at the blunt end thereof should be uppermost when packaging the eggs, as is well-known. This means, therefore, that the eggs 7' when being transferred to the egg tray 22 should be turned about through an angle of approximately 180°.

Figure 3:
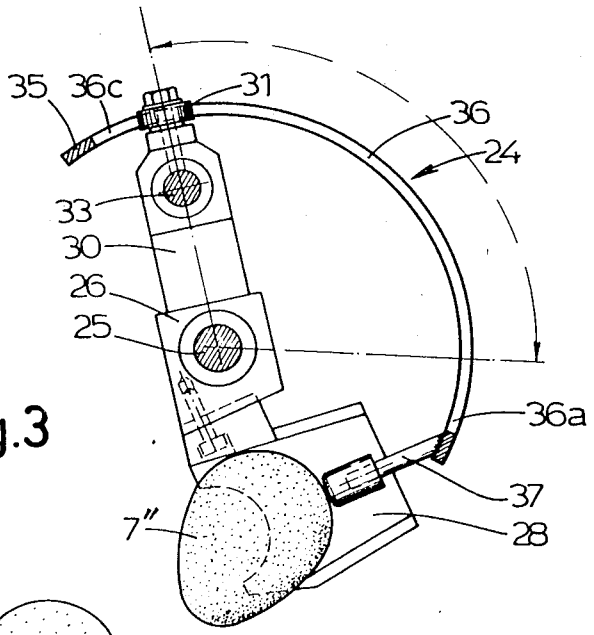
FIG. 3 is on an enlarged scale a vertical section of the transfer device in the egg receiving position thereof, which section is seen along a plane III—III of FIG. 5, passing through a guide slot.
Figure 4:
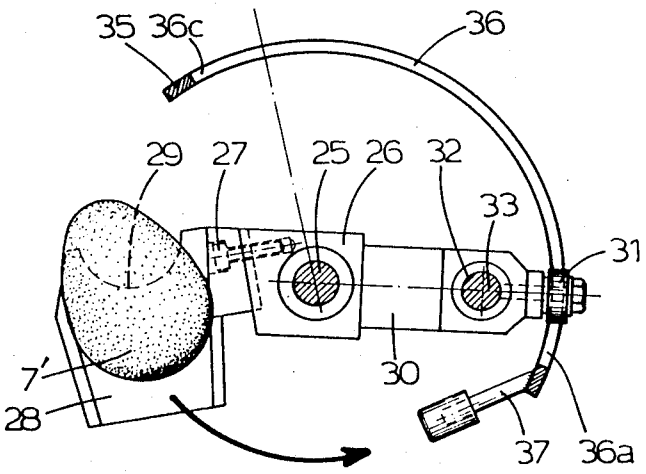
FIG. 4 is a similar vertical section as FIG. 3 in which the transfer device is shown in the discharging position and in which also an egg tray is shown.
Figure 4:
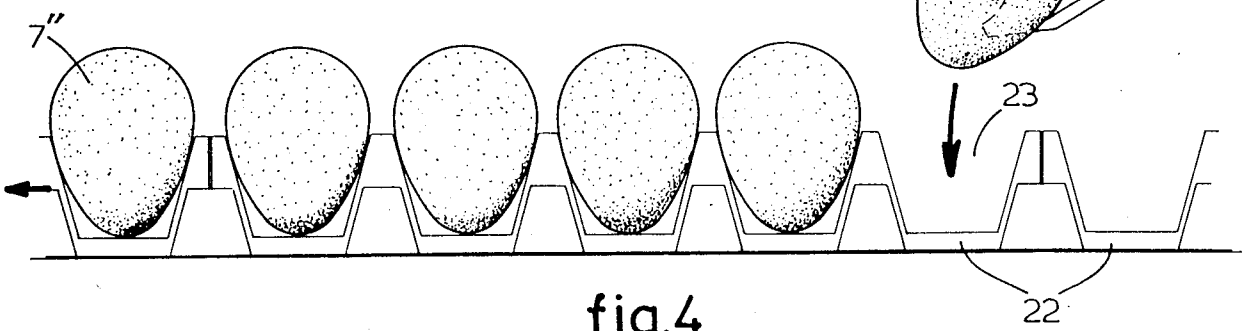

The invention provides a transfer device, generally indicated by 24 and shown separately in FIGS. 3 and 4, for transferring the eggs delivered by the orienting device 16 to an egg tray 22 placed therebelow. The transfer device 24 comprises a shaft 25 rotatably mounted in the side walls 2 of the machine, on which shaft a row of six supporting blocks 26 are axially slidably mounted which blocks 26 each support an egg holder 28 secured by a screw 27 to one side of the block. The egg holder 28 has a cup-shaped slightly conical configuration with an open bottom and half-circular recesses 29 formed in its circumferential upper edge so as to be adapted to receive an egg 7' with the blunt end thereof facing inwardly as shown in FIG. 3. At its side opposite of the holder 28 each block 26 has a radially extending arm 30, which carries a guide roller 31 at its free outer end and which at a short distance from this guide roller 31 is provided with a cross bore 32. A guide rod 33 slidably extends parallel to the shaft 25 through the aligned cross bores 32 of the six arms 30 which guide rod 33 is secured at both of its ends to the shaft 25 by means of coupling members 34 (FIG. 1) so as to rotate with the shaft. The arms 30 thus extend in a common radial plane through the axis of the shaft 25 so as to be rotated together with the shaft while maintaining their parallel positions whereby also the egg holders 28 stay horizontally aligned in each angular position of the shaft 25.

A guide plate 35 bent to the configuration of a cylinder segment is mounted between the frame side walls 2 in a position concentric to the shaft 25 which curved guide plate extends through an arc of approximately 120° above and to the rear of the shaft 25. Six guide slots 36 are cut-out in this guide plate 35 in which slots the guide rollers 31 are received. As can best be seen in the flat development of the plate 35 as shown in FIG. 5, the guide slots 36 have at one end short straight end portions 36*a* extending in radial planes with respect to the shaft 25 at a transverse distance from each other equal to the distance a. At their opposite ends the guide slots 36 have short end portions 36*c* likewise positioned in radial planes but at a mutual transverse distance equal to the distance b. The end portions 36*a* and 36*c* of these slots 36 are connected by inclined slot portions 36*b*, the angle of inclination of these middle slot portions decreasing symmetrically from the outer slots 36 inwardly in a manner as shown in FIG. 5. It is to be noted that in FIG. 5 the wider spread end portions 36*a* are shown at the upper side of the plate 35 and the end portions 36*c* at the lower side of the plate for the sake of clearness but that because of the actual arrangement of the parts of the device the wider spread end portions 36*a* of the slots 36 are in fact situated lower than the slot end portions 36*c* as appears from FIGS. 3 and 4.

In operation the shaft 25 is reciprocated by suitable drive means not shown through an angle of about 105° between an egg receiving position shown in FIG. 3 and an egg discharging position shown in FIG. 4. In the receiving position of FIG. 3 the outer ends of the arms 30 are located in the end parts 36*a* of the guide slots 36 whereby the egg holders 28 are spread apart to the distance a and in a position aligned with the centre lines of the tracks defined by the partition plates 20 of the orienting device 16, the holders facing upwards at a small angle of inclination to the vertical close to the rear end of the roller chain 17 in such a manner that the oriented eggs delivered by this chain can slide downwardly from the roller chain to be received with their blunt ends in the holders 28 without any risk of breakage. The shaft 25 is then rotated anti-clockwise as seen in FIG. 3 whereby the arms 30 moving with their outer ends through the guide slots 36 and thus the egg holders 28 are shifted inwardly towards each other until the guide rollers 31 of the arms 30 reach the slot end portions 36*c* in the discharging position of FIG. 4 in which the egg holders 28 are aligned with a cross row of egg holding recesses 23 of the egg tray 22, the distance between the centres of the holders 28 being equal to the distance b between the centres of the recesses 23. The egg holders 28 situated above the egg holding recesses 23 of the selected row are downwardly inclined at an angle of about 30° to the horizontal (FIG. 3) whereby the eggs 7″ can now slide out of the holders to be dropped with their acute ends into the recesses 23 of the selected row therebelow. Ejector rods 37 carrying rubber caps are secured to the lower edge of the guide plate 35 so as to enter the open undersides of the respective holders 28 in the discharging position thereof whereby the eggs are pressed outwards at the correct moment in case the eggs are slightly stuck in the egg holders.

The egg trays 22 are supplied one by one from a tray storage means 38 onto a conveyor 40 supported in an auxiliary frame 39 extending closely below the tranfer device 24 which conveyor receives the egg trays in a continuous row, the trays being held on the container in six position between cross rods 41 (FIG. 1). The conveyor 40 is driven stepwise in a manner that each following cross row of egg receiving recesses 23 is moved to the correct position below the holders 28 of the transfer device 24 when these holders are moved to the delivery position of FIG. 4. The starwheel device 9, the orienting device 16, the transfer device 24 and the conveyor 40 are driven by common drive means through a suitable cam disc means (not shown) arranged in a box 42 in such a manner that these devices are moved step by step in the correct relationship in order that the orienting device 16 supplies the next cross row of eggs when the holders 28 are in the receiving position of FIG. 3 and these holders then deliver these eggs to a succeeding row of egg holding recesses 23 of a supplied egg tray 22.

While the invention has been illustrated and described with reference to a specific embodiment thereof, it will be understood that other embodiments may be resorted to within the scope of the following claims.

What is claimed is:

1. Machine for packaging eggs comprising:

means for supplying eggs arranged in successive cross rows of a predetermined number, said eggs being equally spaced in said cross rows at a first distance between their longitudinal axes, and aligned and oriented with their blunt ends facing in the direction of supply movement, means for supplying egg container means having egg holding recesses, said recesses being arranged in parallel cross rows of a number equal to said predetermined number of cross rows of said eggs and equally spaced in said cross rows at a second distance between their centers smaller than said first distance, and transfer means for receiving said successive cross rows of oriented eggs to transfer said rows to successive corresponding cross rows of said egg holding recesses of said egg container means, said transfer means comprises, (i) a horizontally extending cross row of egg holders mounted for common rotation and supported for transverse sliding movement with respect to each other, (ii) driving means for rotating said rotatable row of egg holders between an egg receiving position and an egg discharging position, and (iii) egg holder control means cooperating with said egg holders to shift said egg holders laterally with respect to each other during said rotating movement so that, the centers of said egg holders in said receiving position being relatively spaced by said control means at said first distance and said egg holders facing upwards for receiving a row of said oriented eggs from said egg supply means and the centers of said egg holders in said discharging position being relatively spaced by said control means at said second distance and facing downwards for dropping the eggs received therein into said row of egg holding recesses wherein said first distance is larger than said second distance, and a cross row of ejector means, and egg holders having an open bottom and said ejector means being arranged to project through said open bottoms of said egg holders in the egg discharging position of the latter for ejecting the eggs therefrom.

2. The machine of claim 1 in which said egg holders have a substantially cup-shaped conical configuration.

3. The machine of claim 1 in which said egg holders in said discharging position thereof are downwardly inclined.

4. The machine of claim 1 further comprising a frame, a drive shaft rotatably mounted in said frame, a number of supporting blocks non-rotatably but axially slidably mounted on said shaft, each supporting block carrying one of said egg holders, a radially extending arm secured to each supporting block said arms of said number of supporting blocks having outer ends located in a common radial plane, a number of guide track means, one for each of said arm ends, each extending concentrically about said shaft and each controlling the lateral position of one of said supporting blocks on said shaft, said guide track means laterally converging from said first larger distance to said second smaller distance from the location said arm ends occupy in said slots in said egg receiving position of said egg holders to the location said arm ends occupy in said slots in said egg discharging position of said holders.

5. The machine of claim 4 further comprising a guide rod extending parallel to and spaced from said shaft, means secured to the ends of said guide rod fixedly connecting said guide rod to said shaft for rotation therewith, said arms being axially slidable on said guide rod.

6. The machine of claim 4 in which said guide track means comprise a curved guide plate extending concentrically about said shaft and guide slots formed in said guide plate adapted to receive said arms.

7. The machine of claim 6 in which the outer ends of said arms are provided with guide rollers fitting in said guide slots.

8. The machine of claim 1 in which said driving means is adapted to reciprocatingly rotate said egg holders through an angle of rotation in the order of 105° between said egg receiving position and said egg discharging position, said egg holders in said egg receiving position facing upwards at a small angle to the vertical and said egg holders in said egg discharging position facing downwards at an angle of substantially 60° to the vertical.

9. The machine of claim 1 further comprising conveyor means for said egg container means horizontally extending below said transfer means, and driving means for said conveyor for driving the conveyor stepwise for positioning rows of egg receiving recesses below said egg holders in said discharging position.

* * * * *